US005988433A

United States Patent [19]

Crum

[11] Patent Number: 5,988,433

[45] Date of Patent: Nov. 23, 1999

[54] SPORTS BALL STORAGE, TRANSPORTER AND DISPENSER FOR COURT PLAYED GAMES

[76] Inventor: Martin D. Crum, 17282 Ave. 324, Visalia, Calif. 93292

[21] Appl. No.: 09/148,386

[22] Filed: Sep. 22, 1998

Related U.S. Application Data

[60] Provisional application No. 60/058,107, Sep. 5, 1997.

[51] Int. Cl.[6] ..... A47F 1/04

[52] U.S. Cl. ..... 221/309; 221/311; 221/280

[58] Field of Search ..... 221/303, 309, 221/311, 310, 312 R, 279, 280

[56] References Cited

U.S. PATENT DOCUMENTS

| | | | |
|---|---|---|---|
| 3,777,933 | 12/1973 | Joliot | 221/309 |
| 3,968,522 | 7/1976 | Reiss | 2/250 |
| 4,042,156 | 8/1977 | Knight | 224/5 D |
| 4,082,209 | 4/1978 | Sanders | 221/309 X |
| 4,299,345 | 11/1981 | Lanzl | 221/309 X |
| 4,678,108 | 7/1987 | Inman | 224/274 |
| 4,730,728 | 3/1988 | Larkin | 206/315.9 |
| 4,784,305 | 11/1988 | Schoenberg | 224/274 |
| 4,979,742 | 12/1990 | DiFranco | 273/29 R |
| 5,086,948 | 2/1992 | Slusarz | 221/309 X |
| 5,494,411 | 2/1996 | Chuang | 417/234 X |
| 5,810,681 | 9/1998 | Heim | 221/303 X |

*Primary Examiner*—William E. Terrell
*Assistant Examiner*—Gene O. Crawford

[57] ABSTRACT

A cylindrical unit of varying lengths which stores sports balls, with unit capable of attaching to any solid object in a vertical position, close to a sports court or storage area. The unit also serves as a ball transporter, carried in a horizontal or vertical position, with attached handles allowing sports balls to be moved from one sports site or storage area, another. A one piece unit with an opening at one end only, therefore reducing the sports balls exposure, to ball depleting weather, and offers security, by allowing the open end to be locked by a transverse rod across the open end. Balls are contained in storage unit by protrusions located internally, at the open end, positioned at the greatest apex of the ball allowing sports balls to be completely enclosed within the storage unit. Protrusions hold the ball at a distal position within storage unit allowing balls to be loaded and unloaded easily with a single hand. A rod the length of the storage unit has attached a cross of equal diameter as the storage unit. The rod runs internally and centrally the length of the storage unit, exiting the closed end acting as a ball indicator moving parallel to the storage unit as balls are inserted and removed.

15 Claims, 4 Drawing Sheets

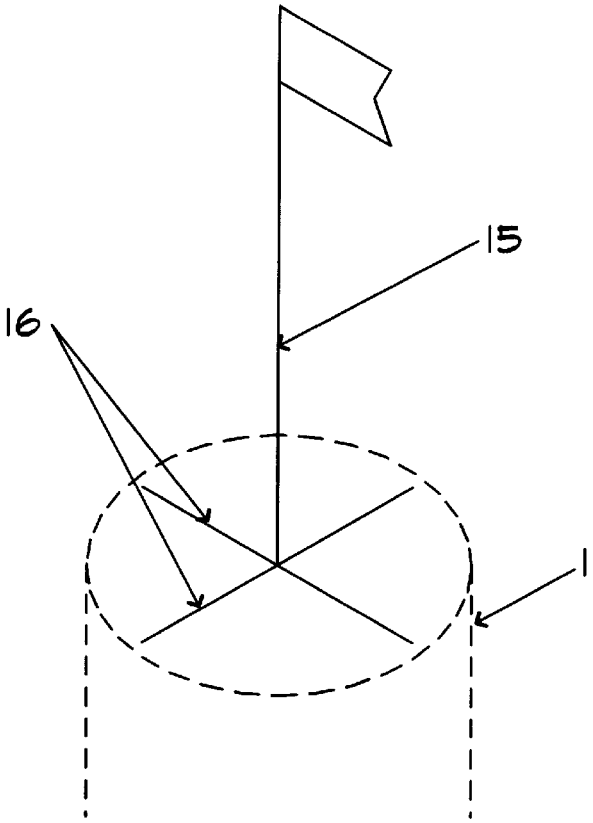
FIG. 4
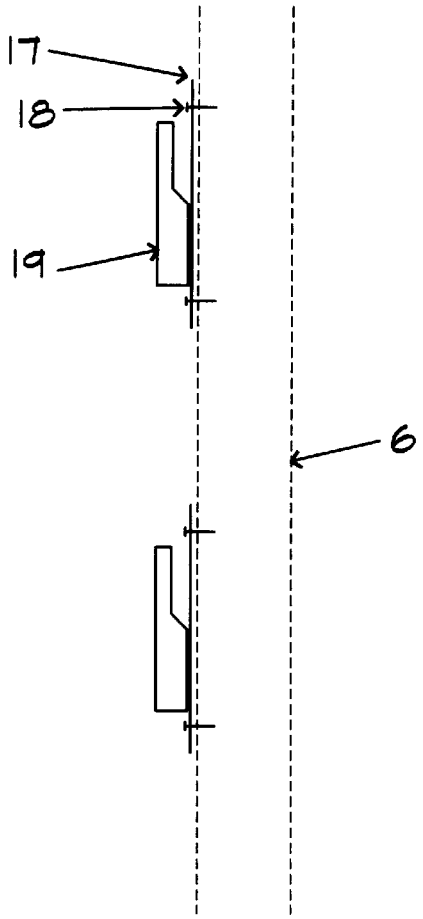
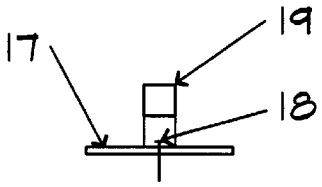
FIG. 6
FIG. 5

SPORTS BALL STORAGE, TRANSPORTER AND DISPENSER FOR COURT PLAYED GAMES

CROSS REFERENCES TO RELATED APPLICATIONS

This patent is based upon an provisional application U.S. 60,058,107 Sep. 5 ,1997.

BACKGROUND—FIELD OF INVENTION

This invention relates to the storage of sports balls close to the proximity of play thus making a convenient storage area while protecting the balls from the elements of the weather, when not in play, in addition, the unit can be used for storage and transporting sports balls from court to court.

BACKGROUND—DESCRIPTION OF PRIOR ART

This disclosure provides a rigid high density plastic tubular structure designed for storage and transporting of sports balls allowing for complete coverage of contained sports balls from depleting weather while in storage unit. Only this invention being constructed of a rigid material, is suitable for inflatable sports balls. With security and weather protection essential elements in development of this invention, for the protection of inflatable sports balls, a tube of rigidity can be used since inflatable balls will compress slightly thus allowing balls to be removed and inserted into the storage unit. Riess, U.S. Pat. No. 3,968,522, Larkin, U.S. Pat. No. 4,730,728 and Schoenberg, U.S. Pat No. 4,784,305 all rely on the flexibility of tube to allow ball to pass through opening while inserting and removing golf balls. Golf balls are of a non-compressible nature. All three above mentioned patents allow stored balls to be exposed to weather and do not have a unique design which will allow for stored balls to be securely locked in the storage unit. Additionally, all above mentioned patents do not allow for complete coverage of the ball, since to remove a ball from these devices one must have access to balls either through a side opening or a top opening to retrieve the balls. Knight, U.S. Pat. No. 4,042,156 and DiFranco, U.S. Pat. No. 4,979,742 also use slots on the tubular structure to retrieve balls from the structure. Since the composition of inflatable sports balls are of the nature that the elements of the weather deteriorate such balls, when stored outside, complete coverage is essential when stored. In addition with the unit placed at the court of play for convenient storage of sports balls, the need to lock balls with minimal exposure when not in use is another unique function of this invention. This invention allows for the user to load and retrieve balls from one entry and exit point. To remove ball one places a hand along inside of the tube between ball and wall (ball is held in a offset position relative to tube) rolling ball down over stoppers with inflatable ball flexing enough for ball to be released from storage unit. The opposite end of the entry and exit opening of ball holding tube is closed. Top and side wall constitute a one piece mold, thus keeping weather from deteriorating sports balls and will further enhance security of balls enclosed with only one opening. Sighting other prior art, Inman, U.S. Pat. No. 4,678,108 employs a full annular ring at opening of elongated tube to hold balls in place and therefore must use a slot located on tube to remove stored balls, exposing them to weather. Furthermore, if inflatable sports balls were to be used in the Inman storage device or others using sight holes, balls could be pried from the unit using the elongated hole present on tube.

Finally, this present invention provides all the needed features for court played sporrs, such as convenience, security, transportation, and weather protection for the recreational and professional ball player.

SUMMARY OF THE INVENTION

Accordingly, several objects and advantages of this invention are storage transporting and dispensing of inflatable sports balls. The invention stores the balls close to the proximity of play as well as protects them from the direct elements of the weather by completely enclosing the stored balls. A further advantage of this invention allows the user to lock the sports balls into the unit thus eliminating the possibility of theft. This invention allows sports balls to be stored at the closest proximity to the court. By this the invention has been designed so that it may be placed at the goal post or any solid structure close to court of play. Typically, sports balls are left in the vicinity of the court allowing the elements of the weather to deteriorate the sports ball and inviting the possibility of theft. This invention eliminates the weather factor and the theft problem by allowing the end user of sports balls to deposit the ball or balls into the non-transparent unit at the lower or underneath opening and securing them with the attached lockable strap across the one opening. This unit may also be placed in any storage room thus allowing for a convenient and secure storage unit for sports balls. Still further objects and advantages will become apparent from a consideration of the ensuing description and accompanying drawings.

BRIEF DESCRIPTION OF THE DRAWINGS

FIG. 4 shows internal cross hairs attached to ball indicator.

FIG. 5 shows a side view of hardware use in mounting Unit to a wall.

FIG. 6 shows in my invention a top view of wall mounting hardware.

DETAILED DESCRIPTION OF THE INVENTION

Figure 1:
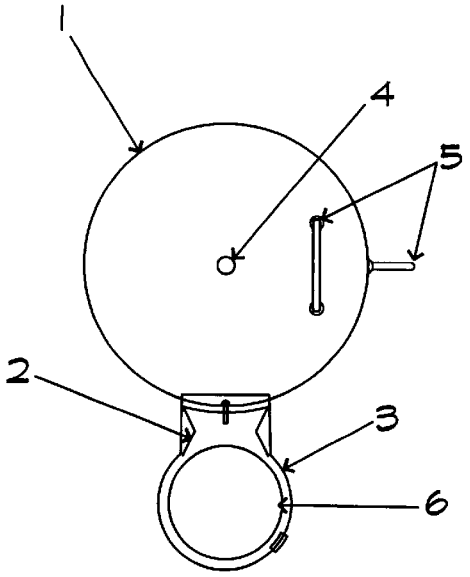
FIG. 1 shows a top view of the invention with handles, ball indicator hole and clamping hardware.
Figure 10:
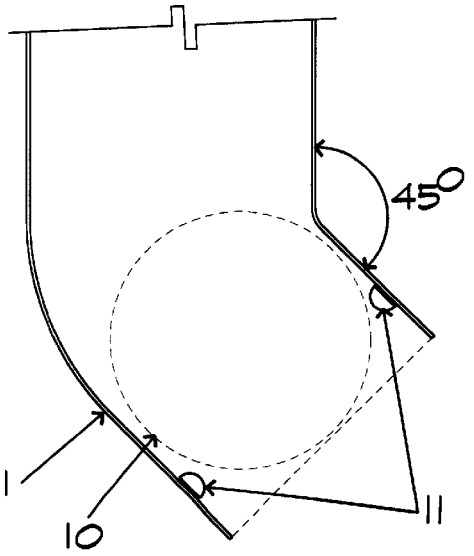
FIG. 10 shows a side view of my invention, a modification of entry an exit for ball or balls.

This invention, SPORTS BALL STORAGE TRANSPORTER and DISPENSER, has the components of a rigid tube in FIGS. 1 & 10, tube 1 being of straight in length or (FIG. 10) having a 45 degree angle at the opening 36 (entry and exit being of the same passage point for sports ball 10). The tube 1 is constructed of non-transparent material to prevent deterioration of the sports ball or balls from the elements of the weather while being stored outside. The tube 1 which comprises the unit, has an opening only at one end to allow the deposit and retrieval of ports balls through opening 36 (FIG. 3).

Figure 2:
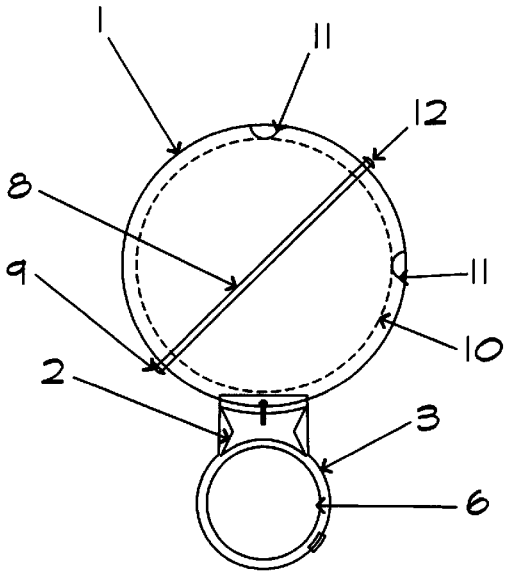
FIG. 2 is a bottom view of the invention showing ball retaining units, locking strap, and clamping hardware.

When balls are not in use, if necessary the balls can be locked, (FIG. 2) into the storage unit by securing the strap 8, hinged at 12, diagonally across opening 36 of the storage tube 1 securing at opening 9 with a lock, by fastening lock through opening 9 in strap 8 and hole 37 in tube 1.

Figure 7:
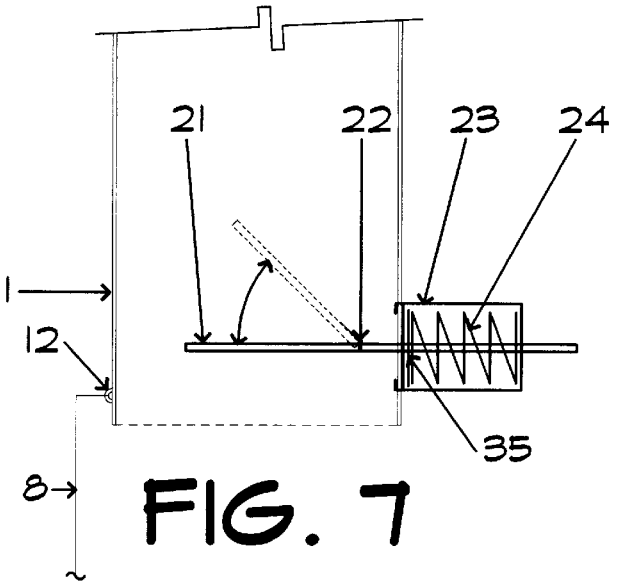
FIG. 7 shows a side view of the internal ball retaining peg.
Figure 8:
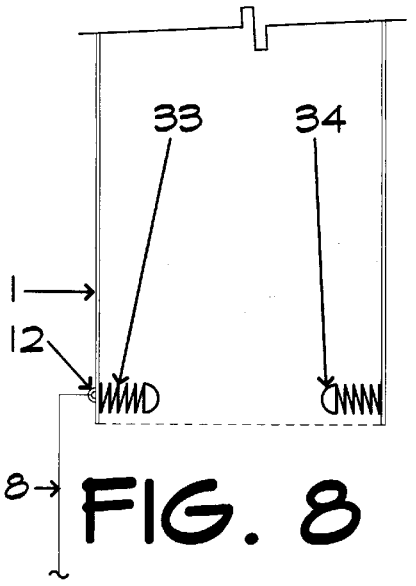
FIG. 8 shows a side view of internal, modified stoppers used to hold ball or balls in position.
Figure 9:
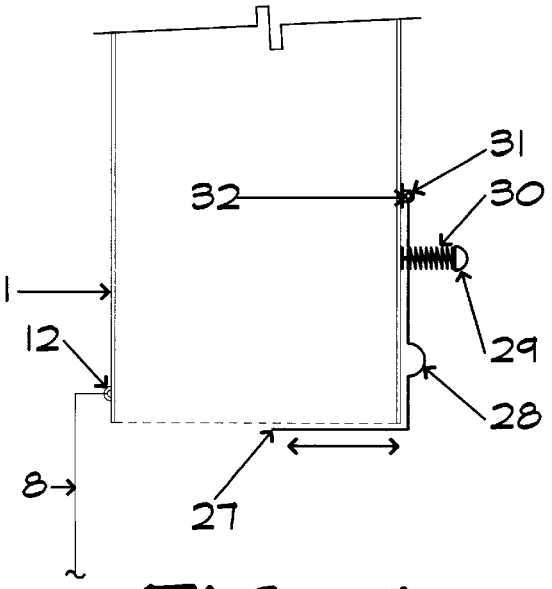
FIG. 9 shows a side view of external modified stoppers used to hold ball or balls in position.

Balls are held into the storage position, (FIG. 3) within tube 1 by two flexible offset stoppers 11 approximately one third the distance apart of the diameter of tube 1 positioning the ball 10 at an offset position of center within the tube 1. With this distal position of the ball 10 it allows for a user to retrieve a ball 10 effortlessly by placing ones hand along the side of the ball 10 and against the inside of the tube 1, rotating the ball 10 down and out of the storage tube 1 to be used for play. These stoppers 11, also allow for tho easy insertion of the sports ball 10 into the unit after use. FIG. 7 shows one modification to the stoppers 11 with arm 21 hinged at 22 folding vertically in tube 1 as a ball 10 is inserted into the tube 1. Ball 10 is released by pulling rod 21 perpendicular from tube 1 compressing spring 24 allowing enough clearance in tube 1 for passage of bail 10 out of storage unit 1. FIG. 9 shows another modification for holding balls into tube 1 by arm 27 hinged at 31 held in place by spring 30 over stationary peg 29 having finger loop 28. By pulling arm 27 away from the storage tube 1 allowing sufficient clearance for ball 10 to be placed into or removed from tube 1. FIG. 8 shows one additional modification for holding ball 10 in tube 1 by two springs 33 & 34 which are compressed as ball 10 is moved into tube 1. Springs are of the strength to hold ball 10 in tube 1 while in storage, but of flexible strength to allow easy removal of ball 10 from tube 1 by placing ones hand inside tube 1 and along side ball 10, rotating ball 10 down and out of tube 1.

Figure 3:
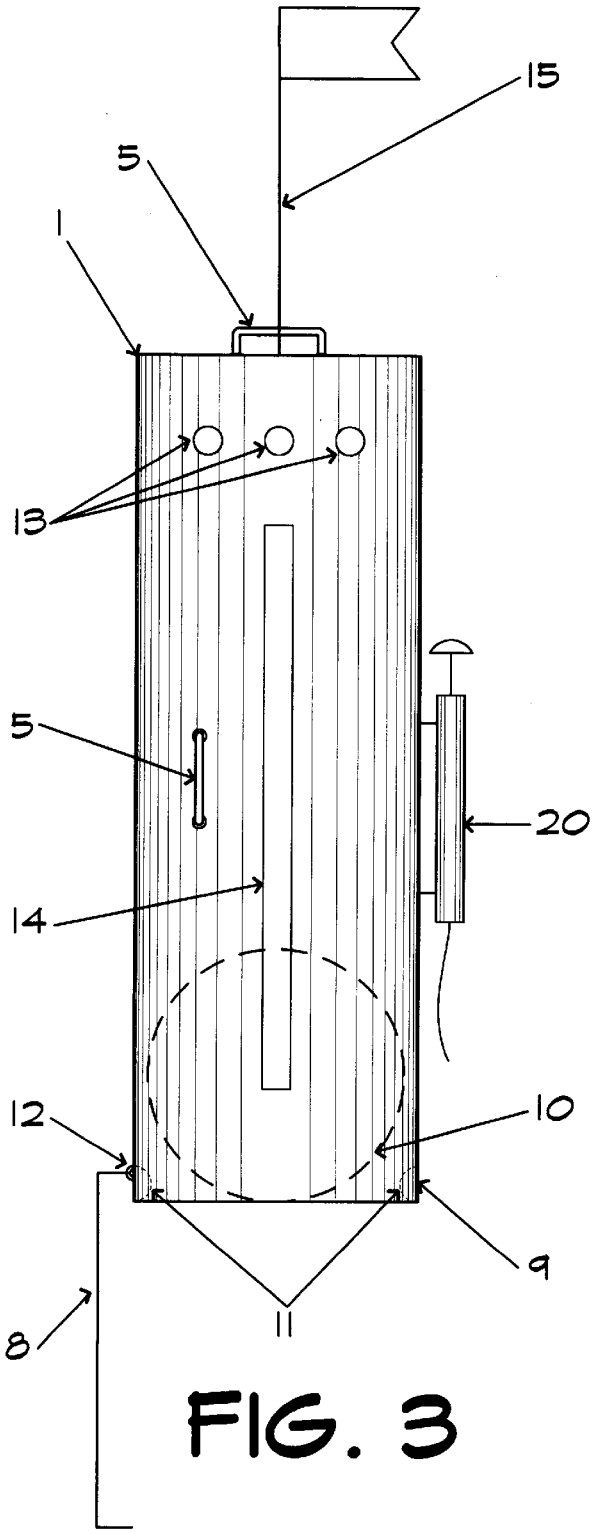
FIG. 3 is a side view of the invention showing ball indicator, carrying handles, locking hardware.

This invention also supports a hand pump FIG.3, 20 to inflate the ball or balls 10 if necessary during play or after periods of long storage of ball 10.

This invention maybe securely fastened in close proximity of playing courts (FIG. 1 & 2) by two clamp straps 3 located at equal distance from the end of tube 1, clamp straps 3 interwoven through the storage tube 1 and around any rigid pole 6. The storage tube 1 may also be retrofitted (FIG. 5 & 6) with peg 19 and slot 2 (FIG. 1) on the outside of tube 1. Peg 19 is molded to plate 17 and fastened to wall by screw 18. Peg 19 fits on to slot 2, FIG. 1 allowing tube 1, to be positioned vertically on wall. Storage tube 1 may be lifted by handle 5 (FIG. 1) and removed from an area and taken to another area while containing sports ball 10.

FIG. 4 shows a ball indicating rod 15, a cross hair 16 (located internally in tube 1 FIG. 1), cross hair 16 being equal to the diameter of the tube 1, and attached to the rod 15 extending the length of tube 1, exiting the closed end of the storage tube 1, moving perpendicular to the storage unit 1 as balls 10 are inserted or removed, thus allowing one to determine at a distance if sports balls are in the storage unit 1. A modification of the ball indicator (FIG.3) will be a slot 14, ¾ the length of the tube 1, ⅛ the circumference of tube 1, in width allowing visual access of the ball 10 in the storage tube 1.

Air vent holes 13 (FIG. 3) are placed equally around the top of storage tube 1 for internal air circulation.

Figure 11:
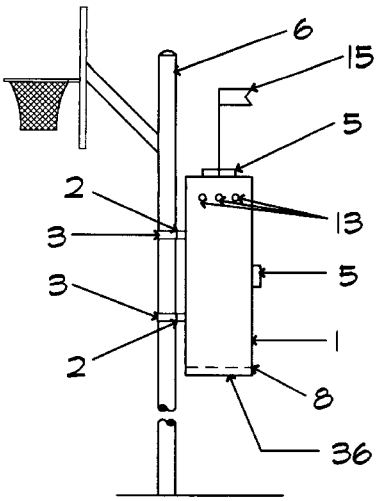
FIG. 11 shows a side view of storage unit attached to poles of associated sports.
Figure 11A:
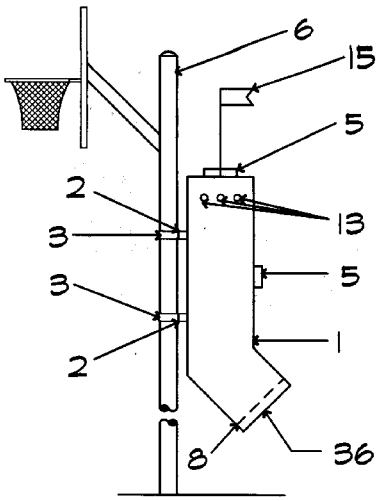
FIG. 11*a* is a side view of storage unit attached to a pole with a modified ball entry and exit.
Figure 12:
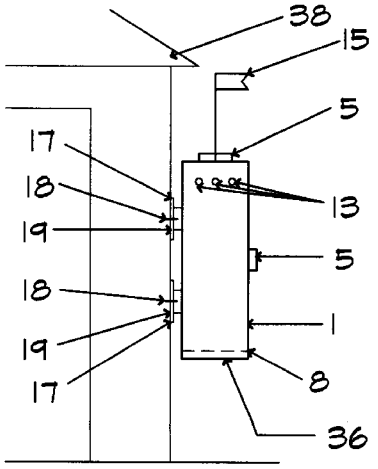
FIG. 12 is a side view of storage unit attached to suitable wall.
Figure 12A:
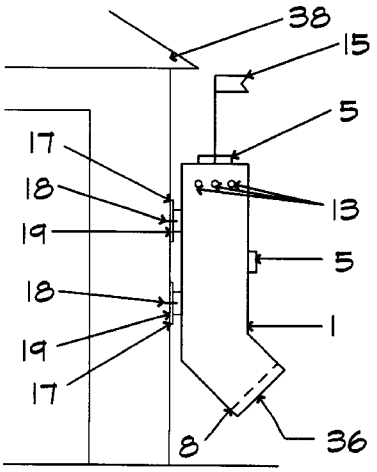
FIG. 12*a* is a side view of storage unit with modified ball entry and exit.

FIG. 11 and 11*a* show side view of tube 1 attached to pole 6 in a designed application. FIG. 12 and 12*a*, show a side view of tube 1 attached to suitable wall 38 where ever convenient storage of sports balls are needed.

Best Mode of Operation

Operation of the SPORTS BALL STORAGE, TRANSPORTER, DISPENSER and its usefulness to the sports enthusiast are straight forward and has many multi applications for the recreational or professional sports ball player. To employ one of the many useful ways for this product to function, one may place tube 1 FIG. 1 at any convenient court of play by attaching to pole 6 with straps 3 or wall 38 (FIG. 12) with peg 19 and slot 2 shown in FIG.5, creating convenient handy dispenser for sports balls. After positioning tube 1, a user simply retrieves one sports ball (assuming balls have been inserted) out of tube 1 by placing ones hand along inside of tube 1 from opening 36 rotating ball 10 down and over stoppers 11 or springs 33 & 34. Ball 10 may, in addition to previous mentioned stoppers would be held in position by springs 33 & 34. If prior to placing tube 1 into position user has not positioned ball 10 into tube 1, one simply places ball 10 at opening 36 pushing ball 10 into tube 1 until stoppers 11 or springs 33 & 34 or arm 21 (which ever ball holding device has been retrofitted with) restraining ball 10 by above mentioned retainers.

On occasion it maybe necessary to lock ball 10 in tube 1 where the possibility of theft may persist. After one has positioned ball 10 into tube 1 the ball 10 can be securely locked by positioning strap 8, hinged at 12 diagonally across tube 1 securing strap 8, with lock through opening 9 in strap 8, and hole 37 in tube 1.

This invention also has the added convenience for the user, a pump 20 attached to tube 1 which allows one to properly inflate ball 10 after long periods of storage or heavy use.

The storage tube 1 may also be retrofitted with peg 19 and slot 2 on the outside of tube 1 so that one may mount to a flat surface such as a wall. One mounts peg 19 in a vertical position, peg 19 held to wall by fasteners, to any surface where convenient storage of sports balls are desired. Slot 2 on tube 1 is positioned down over peg 19. For added security one simply passes a lock through peg 19 securing tube 1. This peg and slot also allows one flexibility to move tube 1 from area to area. Handle 5 located on the distal end to opening 36 and a handle midway to both ends for balance provide for easy handling of tube 1 while transporting the complete unit from one area to another.

A unique aspect of the design of the sports ball storage transporter and dispenser is rod 15 which extends the length of tube 1 exiting at a central point at the distal end of opening 36 which connects to cross hair 16 located internally in tube 1. As one places ball 10 in tube 1, rod 15 moves distally from opening 36 indicating the presence of ball 10. Rod 15 moves conversely as one removes ball 10 from tube 1. One additional modification for a ball gauge will be the use of slot 14 (FIG. 3). Slot 14 located vertical on the side of tube 1 extending ¾ the length of tube 1. As end user placing ball 10 into tube 1 slot 14 allows enough visibility through slot 14 to visually see the presence or nonpresence of ball 10.

Air vent holes 13 placed around distal end to opening 36 allow for air flow to enter at opening 36 and exit at vent holes 13 and conversely. In critically warm conditions vent holes 13 will reduce the possibility of damage to sports ball 10.

FIG. 11 and 11*a* show a side view of tube 1 with its modified opening 36 attached to pole 6.

FIG. 12 and 12*a* show a side view of tube 1 with its modified opening 36 attached to wall 38.

Accordingly, it can be seen that this invention, SPORTS BALL STORAGE TRANSPORTER and DISPENSER provides a convenient means and a highly reliable mode of storage of sports balls at the court of play or in a storage facility, in addition a portable unit to transport sports balls from one sports area to another. This storage unit, with complete enclosure of stored balls within high density plastic, containing ultraviolet inhibitors, which will reduce the effects of the weather on sports balls, when stored outside. It offers a unique means of transporting sports balls from one location to another. Furthermore this invention, offers the user the option of locking balls into storage unit, reducing vandalism or theft which may occur on sports balls while in storage.

Although the description above contains many specificities, these should not be construed as limiting the scope of the invention but as merely providing illustrations of some of the presently preferred embodiments of this invention. Various other embodiments and ramifications are possible within it's scope. For example, this storage unit maybe used in other recreational areas such as swimming pools or soccer fields. In addition to recreational uses, there is an end less need for the storage of round objects within many fields of industry and consumer outlets, where round objects of various size need to be contained.

Thus the scope of the invention should be determined by the appended claims and their legal equivalents, rather than by the examples given.

Reference numerals

7 hole 37
8 opening 9
9 ball 10
10 tube 1
12 opening 36
14 strap 8
16 hinged 12
18 padlock.
20 stoppers 11
22 arm 21
24 hinged at 22
26 rod 21
28 spring 24
30 arm 27
32 hinged at 31
34 spring 30
36 peg 29
38 loop 28
40 springs 33 & 34
42 pump 20
44 straps 3
46 pole 6
48 peg 19
50 slot 2
52 handle 5
54 rod 15
56 cross hair 16
58 slot 14
60 vent holes 13
62 wall 38
64 plate 17
66 screw 18

What is claimed is:

1. An improved ball holder for the storage, transport, and dispensing of spherical units comprising:

a tube constructed of a rigid material having a cylindrical shape of sufficient diameter to enclose spherical units and allow for passage of spherical units within the tube, the tube being completely enclosed at one end, said tube having internal stoppers for holding spheres internally;

a means for attaching the tube to a solid structure and securing the tube in vertical position;

hand grasping positions located externally of the tube for lifting, carrying, or transporting the tube;

at least two holes each located on the circumference of the tube opposite and facing each other across the greatest diameter of the tube and near the open end of the tube;

a transverse rod located near the open end of the tube, the transverse rod being capable of passing through the holes for securing the contained spheres within the tube;

a means for locking the transverse rod to the tube;

a sphere indicator means comprising a rod which moves along the length of the tube as spheres are inserted and removed; and, an inflating pump located externally of the tube for inflating inflatable spheres.

2. The invention as defined in claim 1, wherein said tube is of a one piece construction.

3. The invention as described in claim 1, wherein said tube is of sufficient length to contain a minimum of one spherical object.

4. The invention as described in claim 1, wherein the attachment means is a clamp or a peg and loop.

5. The invention as described in claim 1, wherein said tube contains a minimum of one position on the external side of the tube for grasping and transporting said tube.

6. The invention as described in claim 1, wherein said transverse rod contains a hole located at a distal end of the rod allowing for the passage of a lock.

7. The invention as described in claim 1, wherein said transverse rod is hinged at a distal end to lock at the open end of the tube.

8. The invention as described in claim 1, wherein said sphere indicator rod exits at the closed end of the tube as spheres are inserted.

9. The invention as described in claim 1, wherein said sphere indication rod contains at a distal end closest to the open end of the tube a cross equal to the diameter of the tube.

10. The invention as described in claim 1, wherein said tube contains vent holes at an end distal to the open end.

11. The invention as described in claim 1, wherein said tube is attached to a solid object means such as a pole or a wall.

12. The invention as described in claim 11, wherein the closed end will be in an upper position and the open end will be at a lower position.

13. The invention of as described in claim 1, said tube containing a minimum of one internal stopper for maintaining spheres within said tube.

14. The invention as described in claim 13, wherein said one internal stopper is located at the open end of the tube.

15. The invention as described in claim 13, wherein said one internal stopper is located at the greatest apex of the open end, so as to hold the sphere completely enclosed within the tube.

* * * * *